US008001804B2

(12) United States Patent
Sakamoto

(10) Patent No.: US 8,001,804 B2
(45) Date of Patent: Aug. 23, 2011

(54) DEVICE TO HANG MULTIPLE ELEMENTS IN MULTIPLE PLANES

(76) Inventor: Edward Sakamoto, Torrance, CA (US)

( * ) Notice: Subject to any disclaimer, the term of this patent is extended or adjusted under 35 U.S.C. 154(b) by 948 days.

(21) Appl. No.: 11/821,393

(22) Filed: Jun. 22, 2007

(65) Prior Publication Data

US 2008/0006054 A1 Jan. 10, 2008

Related U.S. Application Data

(60) Provisional application No. 60/815,591, filed on Jun. 22, 2006, provisional application No. 60/816,325, filed on Jun. 26, 2006.

(51) Int. Cl.
*A44C 15/00* (2006.01)

(52) U.S. Cl. ..... 63/35

(58) Field of Classification Search ..... None
See application file for complete search history.

(56) References Cited

U.S. PATENT DOCUMENTS

| | | | | |
|---|---|---|---|---|
| D264,060 | S * | 4/1982 | Epstein | D11/40 |
| 6,050,529 | A * | 4/2000 | Lin | 248/121 |
| 2005/0138962 | A1 * | 6/2005 | Berge | 63/13 |

* cited by examiner

*Primary Examiner* — Jack W. Lavinder

(57) ABSTRACT

A frame assembly for use with jewelry including earrings, pins, pendants, necklaces, charms and for use with ornaments including Christmas tree ornaments (e.g. display articles) that includes a plurality of legs that are coupled, in such a way to permit swinging, to a vertical member that is attached to the display articles. Each leg includes a ring assembly through which extends another ring either one or both of which may include a pair of hubs that are placed on the outer surface of the rings and such additional ring is coupled to a decorative element.

17 Claims, 21 Drawing Sheets

TOP

FRONT

DEVICE TO HANG MULTIPLE ELEMENTS IN MULTIPLE PLANES

This application claims the prior filing dates of two provisional patent applications filed by this inventor as Ser. Nos. 60/815,591 and 60/816,325, filed on Jun. 22, 2006 and Jun. 26, 2006 respectively.

BACKGROUND OF THE INVENTION

The present invention relates to jewelry that adorns the ear, can be used as a pin, pendant, necklace or charm or a decorative item for use as an ornament for a Christmas tree or other decorative purpose. The common feature for these items in the prior art is a decorative element or several decorative elements attached to the earring, pin, pendant, necklace or ornament that is displayed in a single plane. This innovative design for a frame assembly allows the display of decorative elements in multiple planes and on multiple levels with a plurality of display configurations. The frame assembly invention allows significant swaying of the decorative elements as the wearer moves or the air circulates about an ornament. Additionally rotational movement of the decorative elements is described.

Stud earrings, charm bracelets, pendants, necklaces, pins and ornaments that have decorative elements hung therefrom have been around for many years. The stud element typically consists of a cylindrically (or some other geometric or non-geometric) shaped solid metallic piece and out of one end, through its center, extends a wire post which is placed through a pierced hole in the lobe of the wearer's ear. A spring type nut device that releases upon squeezing between a thumb and finger and mechanically engages the wire when released is added to secure the stud and earring assembly to the ear. Traditionally the decorative element may either attach to the cylinder or to the wire that extends out of the stud. When attached to the cylinder, the cylinder includes a loop which extends out therefrom and the decorative element includes a hook which engages the loop and thus allows the decorative element to dangle from the stud. When attached to the wire there usually extends from the decorative element a metal protrusion of any shape which has a hole through it oriented in such a way as to suspend the decorative element from the wire. For pins, necklaces and pendants the bottom of the structure includes means for attaching the decorative elements. Similarly for a link of a charm bracelet means for attaching the decorative elements are installed between two links and the decorative elements suspend from it. All of these devices permit a decorative device to be displayed in one plane only regardless of the fact that the decorative element may have depth to it and that there may be a plurality of decorative elements.

An innovative advance over the prior art is a removable or non-removable frame assembly for use in displaying the decorative elements. This frame assembly includes two legs or alternatively a multiplicity of legs. The legs can include matched or unmatched straight or curved wires with or without bends or angles or elongated rectangular or other geometric or non-geometric cross-sectioned solids. The orientation of the frame may extend downward, upward or horizontally. The frame assembly legs are soldered (or molded if plastic) together at the center of mass at the top of the frame. A single straight, curved or bent hanging element may extend through the center of gravity of the top of the frame and serve as two hanging frame elements. The frame elements may include means for allowing each decorative element to sway with the movement of the wearer or with air circulation. Soldered or molded together through the top of the frame and extending perpendicular to it is a wire with a loop or ring at the top (or simply it is connected to the wire) that connects the frame-assembly to the stud and wire which attaches to the ear of the wearer or attaches to connection a device for the pin, charm bracelet, necklace, pendant or ornament. The frame hanging elements may include mountings for gems or in the case of the solid cross-sectioned hanging elements, gems may be embedded in the outward facing surface of the solid elements. Due to the many possible combinations of dimensions of the decorative elements and the lengths of the legs and angles between them, the frame assembly permits displays of elements in multiple planes from the perspective of the viewer. Similar or dissimilar frame assemblies may also be stacked to provide pyramidal or cylindrical options for the decorative elements. Also anticipated is means for allowing rotation of the frame assembly by air movement or propulsion for same.

SUMMARY OF THE INVENTION

The present invention includes a decorative design for adorning an ear, pin, necklace, pendant or Christmas tree ornament which includes a removable or non-removable frame assembly that suspends from a stud and wire assembly for an earring or is connected to a pin, pendant, necklace, charm bracelet or ornament. A vertical member at the top of the frame extends to and connects with the device to be adorned. This vertical member is soldered or otherwise securely attached to the center of gravity of the top of the frame. The frame consists of one or more hanging elements that can be straight or curved wire lines, or curved or elongated geometric or non-geometric cross-sectional elongated solids of metal, plastic or any other suitable material. Each such hanging element is joined at the center of gravity at the top of the frame and each may include means to allow each such hanging element to pivot at some point on its length. Specifically anticipated is a ring attached to one or more legs of the frame assembly, the inner void of such ring is pierced by a similar ring attached to the decorative element. One or both of these rings may include two nubs that protrude from the outer circumference of the ring. In one configuration these nubs may be at opposite ends of a diameter of such ring and in any configuration tend to limit the amount of sway that may be permitted between the leg and the decorative element. This is a critical advance particularly for earrings because the nubs prevent fouling and over-twisting of the decorative elements. The hanging elements of the frame may be matched or unmatched in terms of design and may be oriented in any fashion whether geometric or not. The innovation of the frame assembly is that it permits displays of similar or complimentary elements or randomly different elements in multiple planes with respect to the viewer. The invention also includes stacking of the frame assemblies to provide a pyramidal or cylindrical effect. Additionally anticipated is means for allowing rotation of the frame assembly about its vertical member or an electrical or mechanical propulsion system for providing such rotation.

DETAILED DESCRIPTION OF PREFERRED EMBODIMENTS

Figure 6:
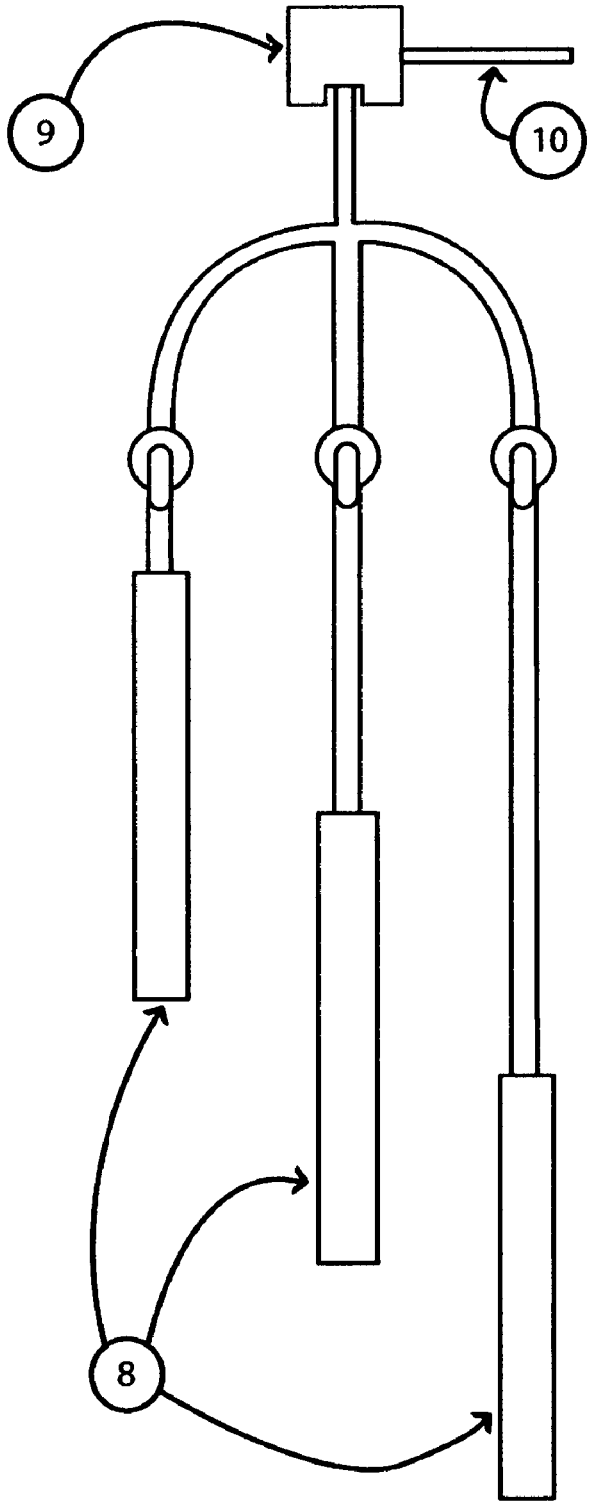
FIG. 6 is a side view of the four legged frame assembly of FIG. 5 and also includes the stud and wire part of an earring
Figure 7:
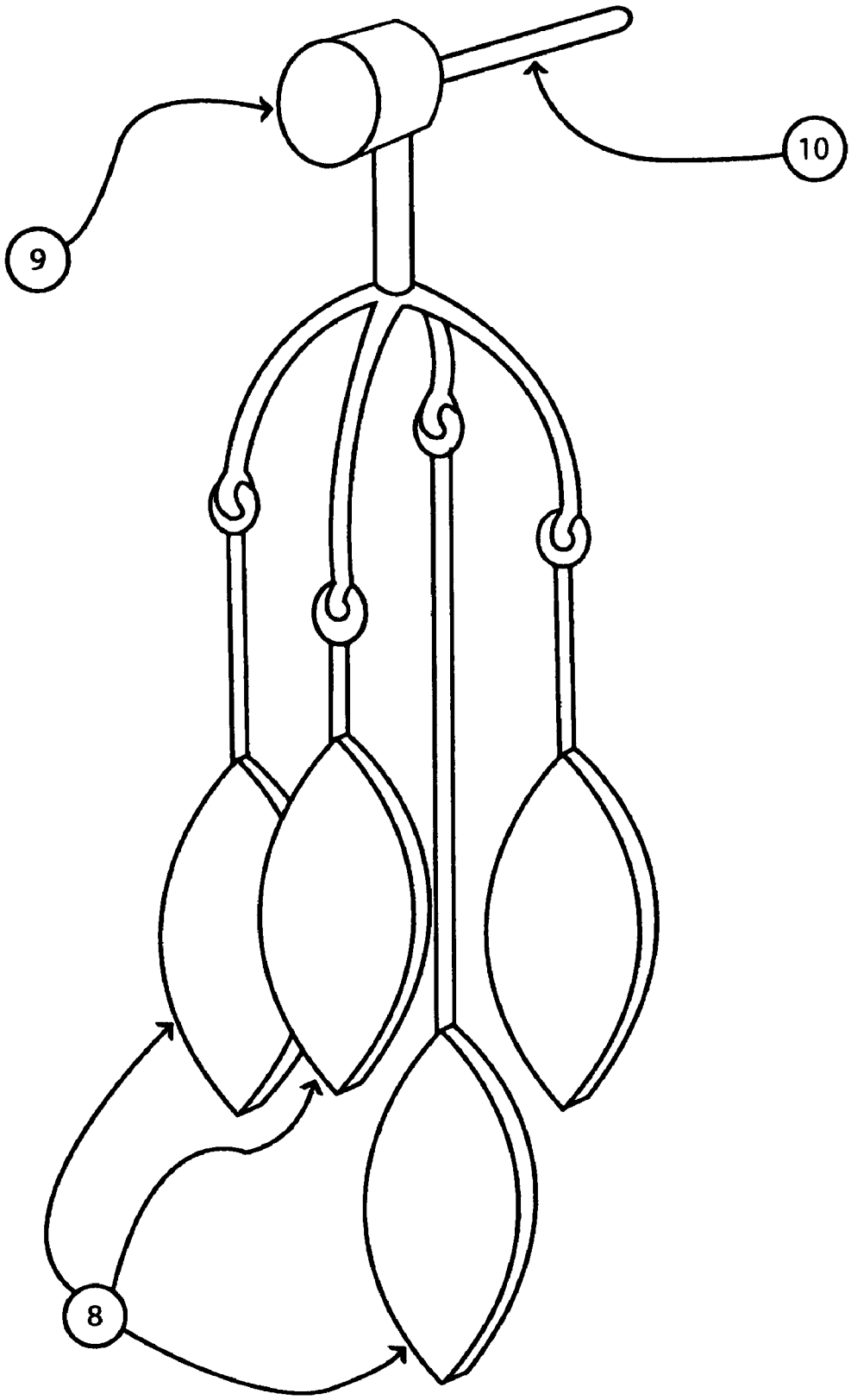
FIG. 7 is a perspective drawing or the four legged frame assembly of FIG. 5

FIGS. 6-7 illustrate exemplary embodiments of an earring design according to the teachings of the present invention, which include a stud 9, wire 10, bottom slot 14, four legged frame assembly 6 and decorative elements 8. The earring is made of precious jewelry metal such as gold, silver or platinum. The individual elements are constructed from any common jewelry fabrication method such as hand fabrication, stamping or lost wax casting.

Figure 12:
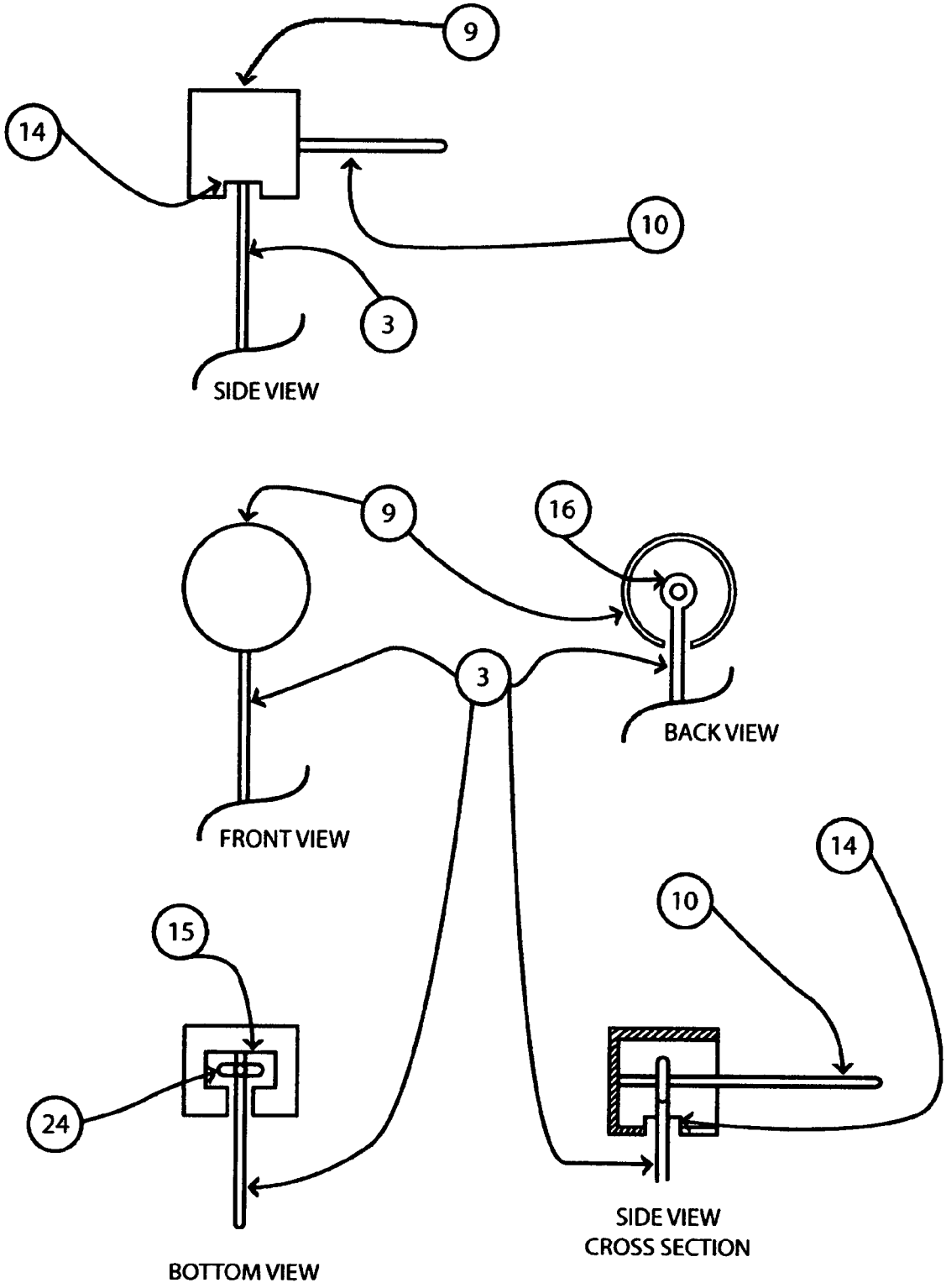
FIG. 12 shows bottom, side front, back and cross section views of the stud and wire and details the transverse slot on the bottom and T shaped bottom slot and connection of vertical member to the wire

FIG. 12 details the stud 9 design allowing removablity of the frame assembly. The top element of the frame assembly is a vertical member 3 that at its tip includes a loop, ring 16 or other means to connect the frame assembly to the wire of the stud. The interior of the stud 9 is hollowed to enable the ring 16 to be slipped onto the wire 10 and additionally provides security and stability while allowing a certain amount of swing. The bottom view shows the "T" shape 15 of this hollowed interior. The side view of the stud 9 reveals a slot 14 that permits additional swing of the frame assembly. In the bottom view the vertical element is seen from its end 24 and the remainder of the frame assembly is not shown.

Figure 5:
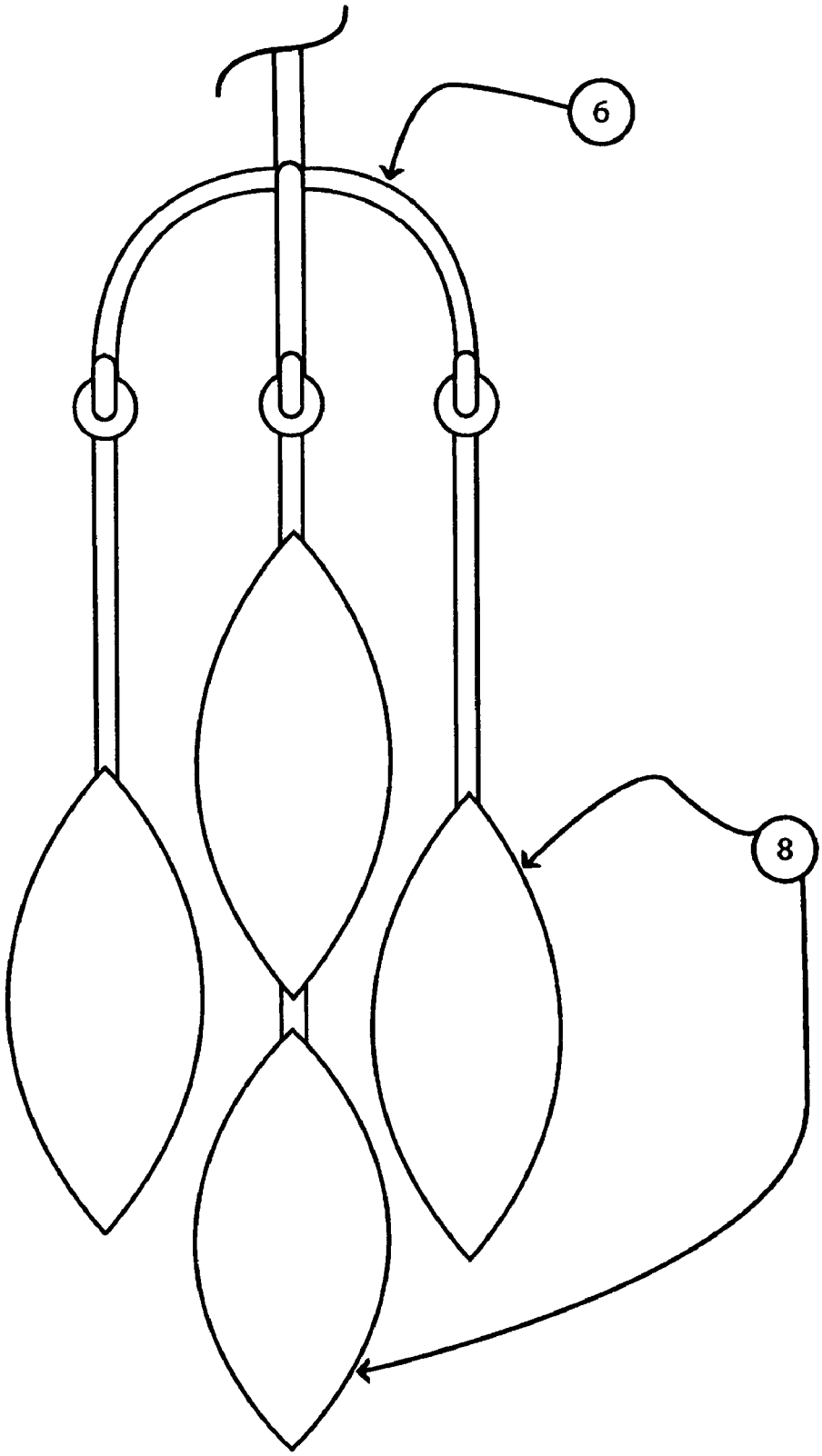
FIG. 5 is a front view of a four legged frame assembly displaying four decorative elements

FIG. 5 shows a side (view of the viewer) of a four legged frame assembly (the earring, necklace, pin, charm bracelet or ornament is not shown) and one possible orientation of the decorative elements 8. The fourth leg 39 is behind the middle leg 38.

Figure 1:
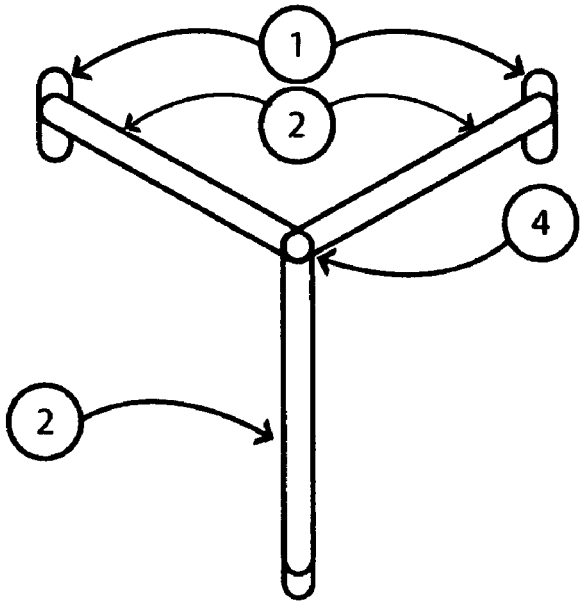
FIG. 1 is a top and side view of a frame assembly top (without decorative elements attached) with three legs
Figure 1:
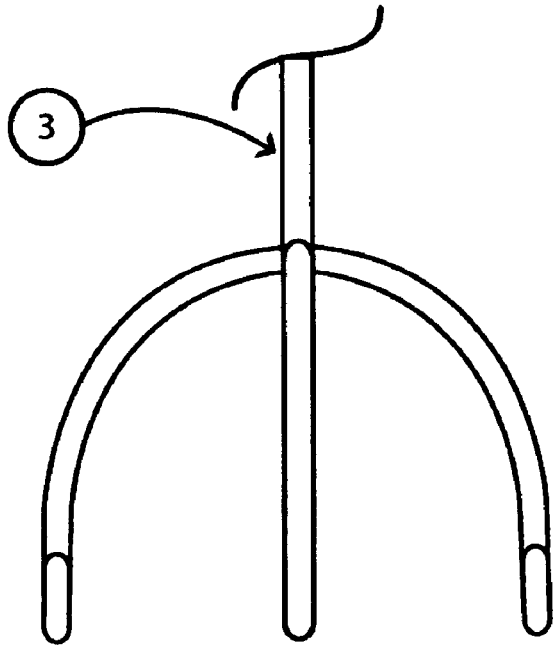
Figure 2:
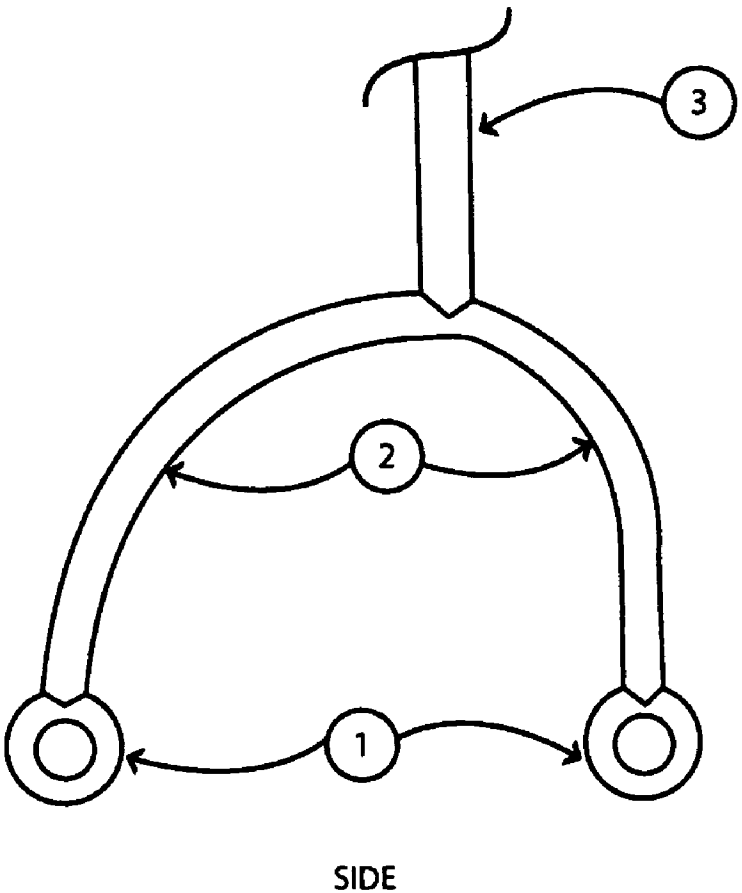
FIG. 2 is a side view of a frame assembly top (without decorative elements attached) with two legs that are asymmetrical or it could be three legged and symmetrical
Figure 3:
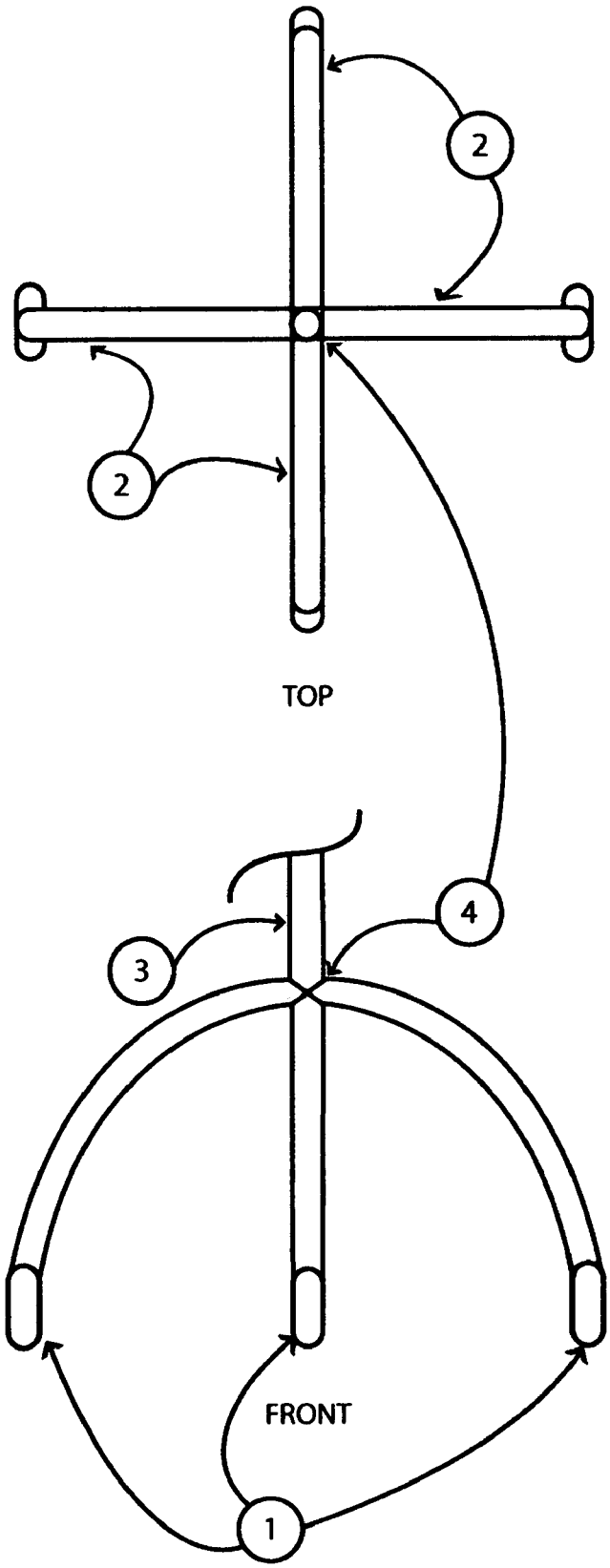
FIG. 3 is a top and side view of a frame assembly top (without decorative elements attached) with four symmetrical legs
Figure 4:
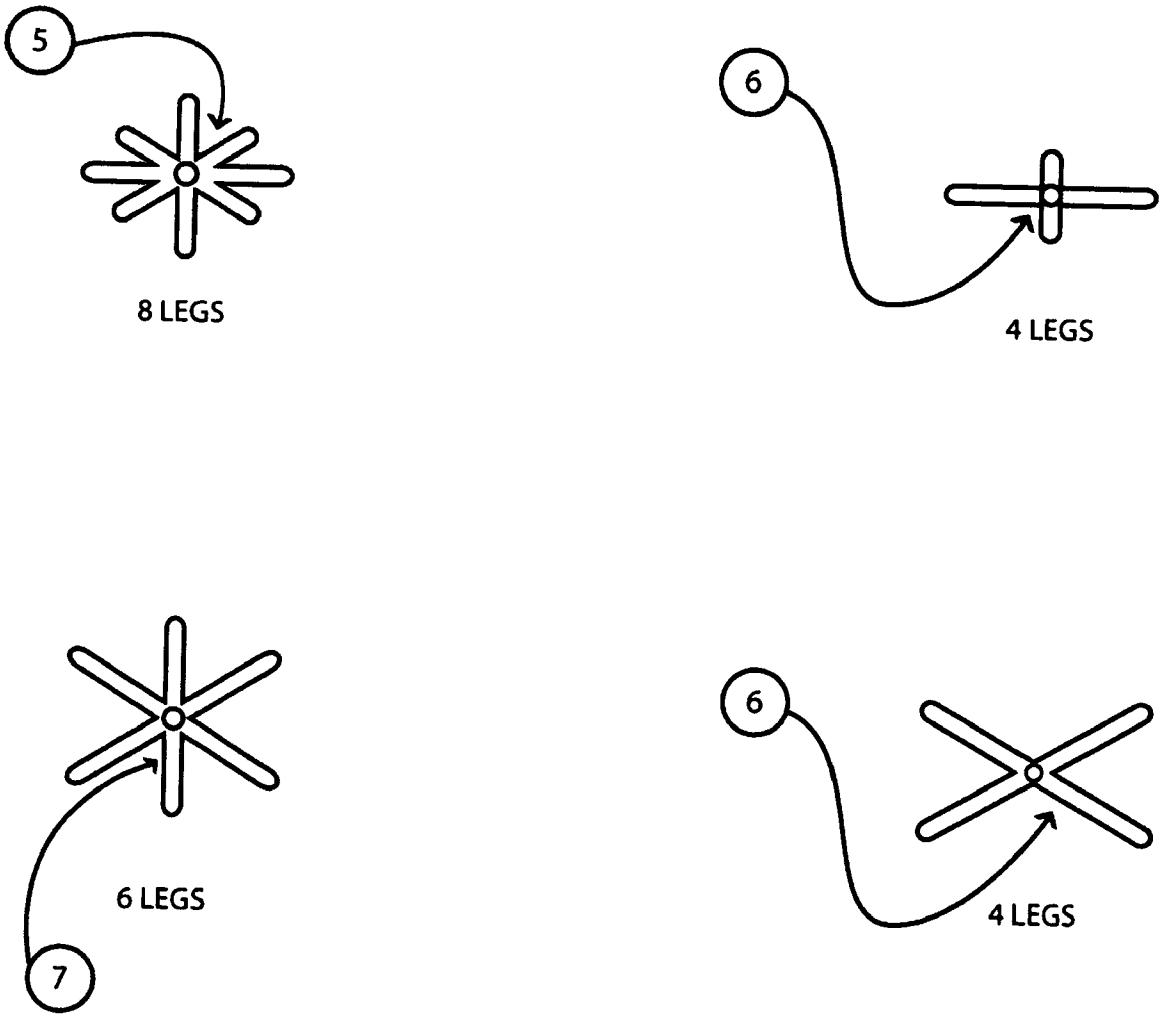
FIG. 4 shows top views of the leg layouts only of frame assemblies of two different four legged layouts and six and eight legged versions

FIGS. 1-3 detail examples of several frame assembly configurations. FIG. 1 shows a top and side view of a three legged, equilateral frame. Connection means 1 are indicated, the legs 2 identified, the connection point 4 between the legs and vertical member 3 is shown. FIG. 2 reveals an asymmetrical configuration for a frame assembly. Ring 11 connectors are shown. FIG. 4 depicts a four legged symmetrical configuration. The legs 2, connection point 4, vertical member 3 and connection means 1 (to decorative elements not shown) are shown.

FIG. 4 suggests an eight legged 5 (all angles between the legs are not equal), six legged 7, and two different four legged 6 flame assembly configurations.

Figure 8:
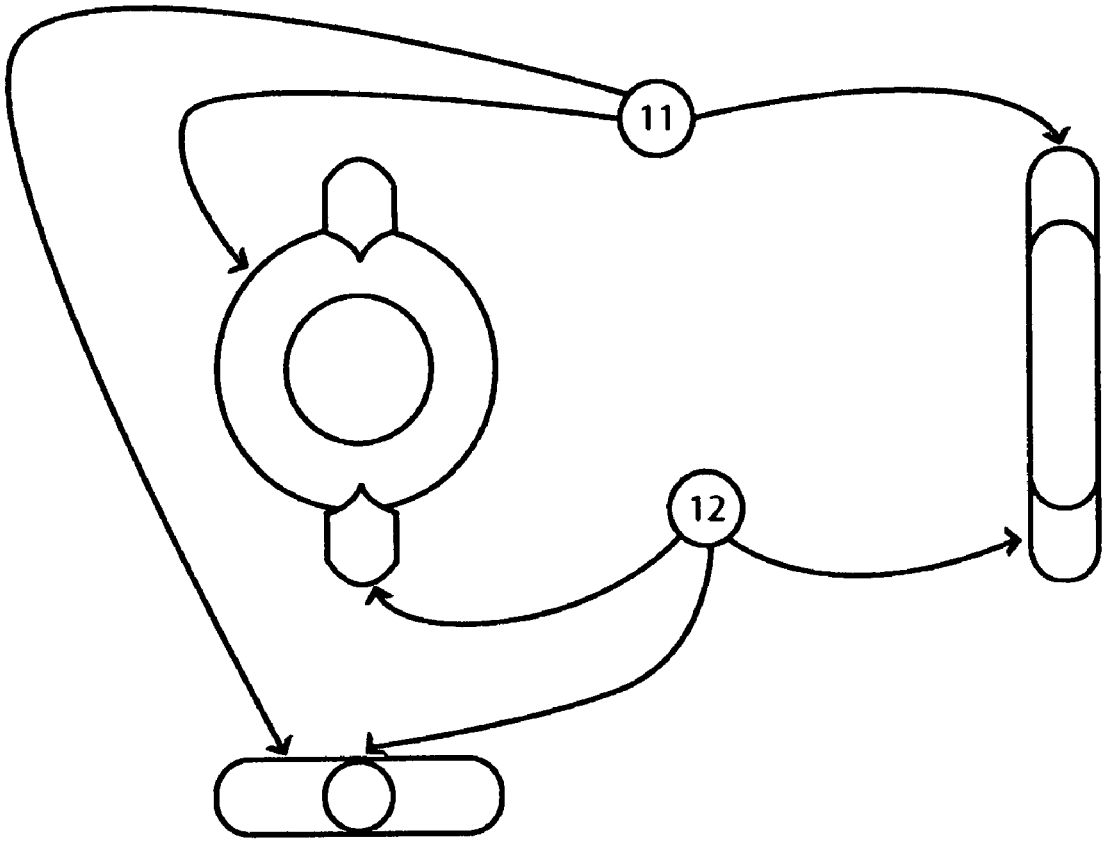
FIG. 8 is a side and front view of a ring with two outwardly protruding nubs that are placed at opposite ends of a diameter of the ring
Figure 9:
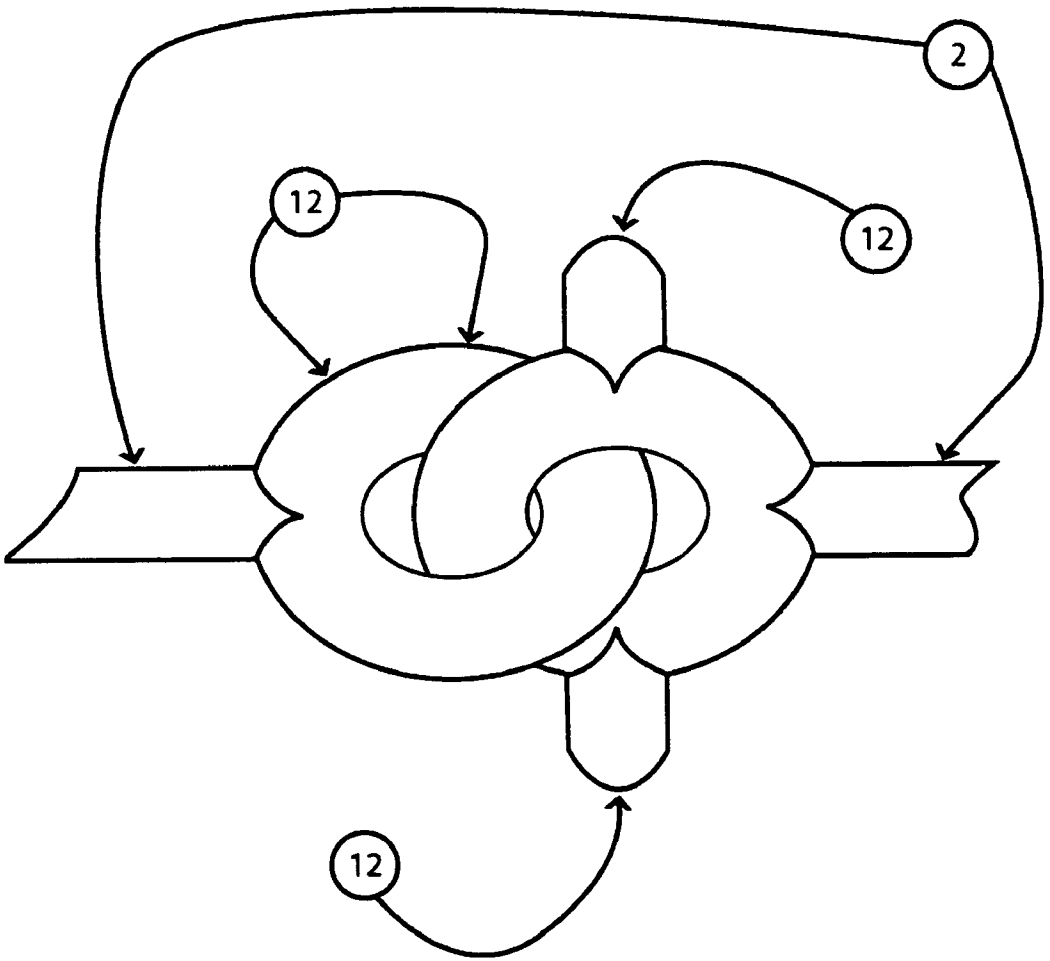
FIG. 9 is a ring assembly wherein nubs appear on only one ring
Figure 10:
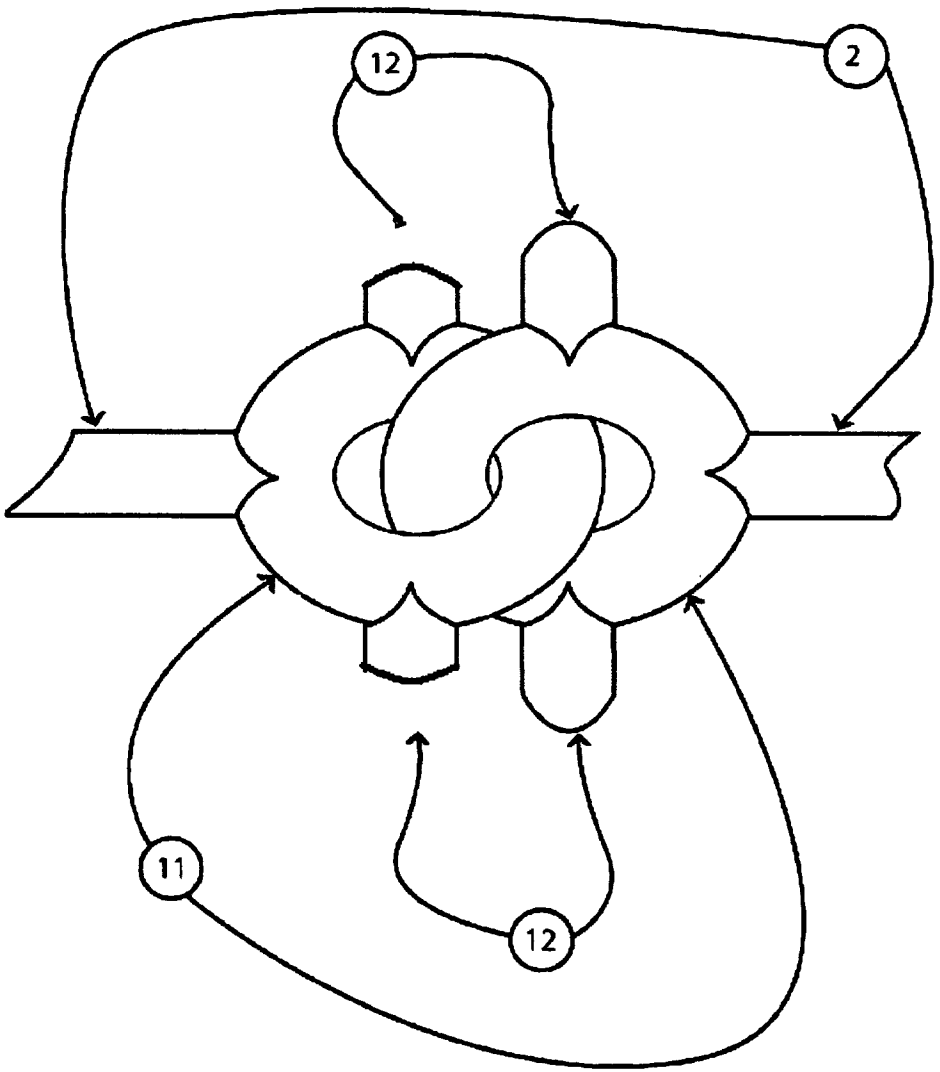
FIG. 10 is a ring assembly wherein nubs appear on both rings
Figure 11:
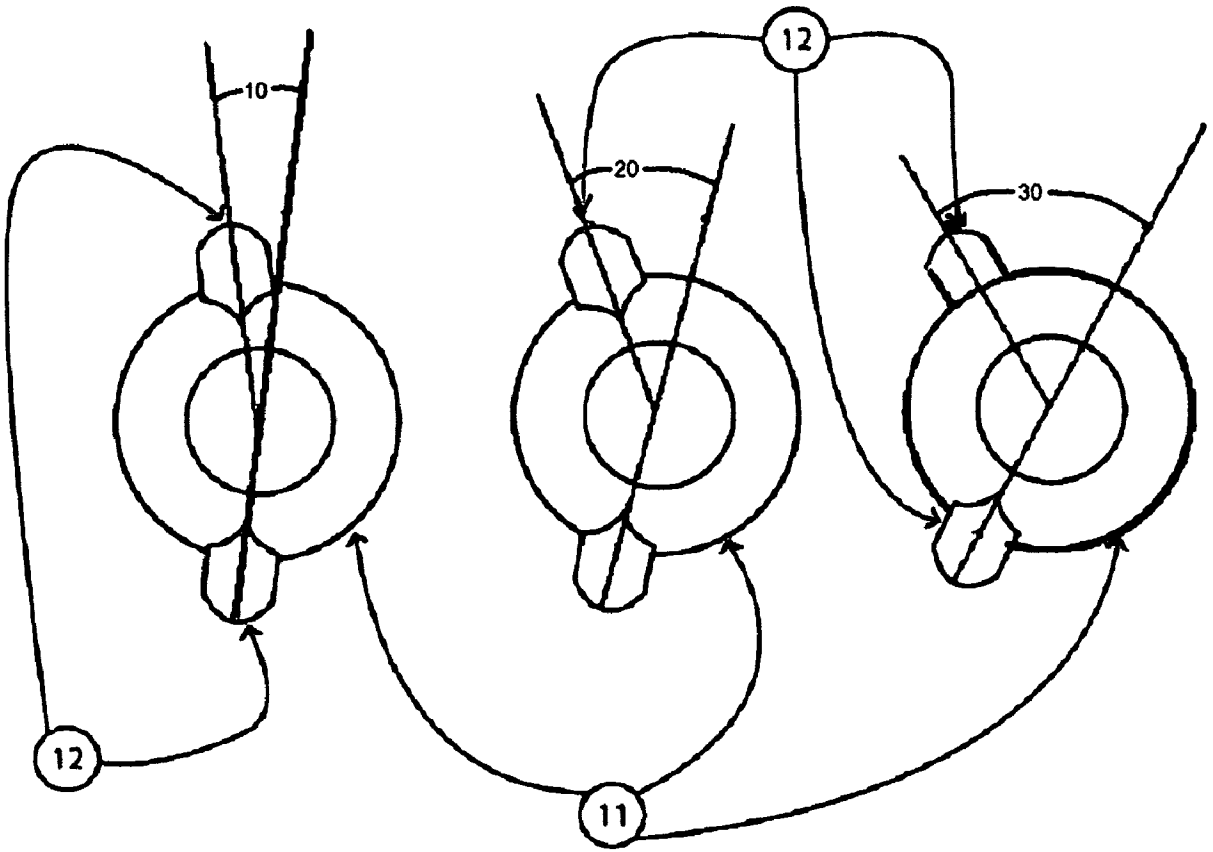
FIG. 11 is a front view of various nub configurations protruding outwardly from three rings

FIGS. 8-11 detail connecting ring configuration. FIG. 8 shows a top view of a ring 11 with two nubs 12 at opposite ends of a diameter on the outer surface of the ring. Side and front views are also shown. FIG. 9 depicts interlocking rings 11 where one ring has 180 degree opposed nubs 12. FIG. 10 reveals an application with 180 degree opposed nubs on both rings. Nubs on one ring tends to limit the rotation of its opposing ring whereas nubs on both rings tend to limit the rotation of each other. One hundred eighty degree opposed nubs situated perpendicular to the leg attached to the ring, provide the maximum limitation to rotation and prevent fouling and over-twisting of the decorative elements. FIG. 11 shows other possible nub configurations with deflections of 10, 20 and 30 degrees.

Figure 13:
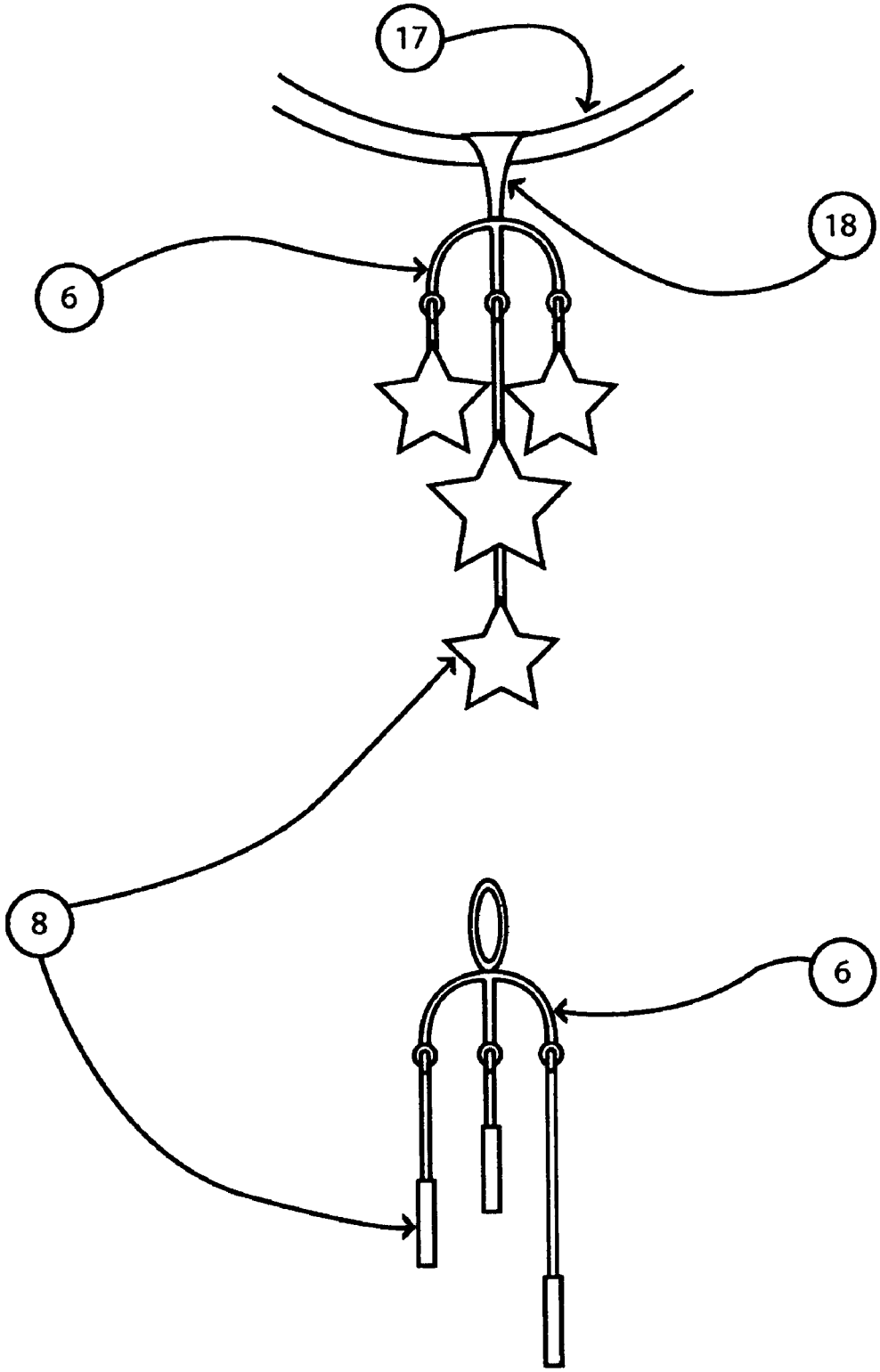
FIG. 13 is a frame assembly as used with a necklace and shows a precious metal graduated loop as the attachment device between the frame and necklace

FIG. 13 details the four legged symmetrical frame assembly connected to a necklace 17 using a decorative pendant loop 18 and showing sample decorative elements 8.

Figure 14:
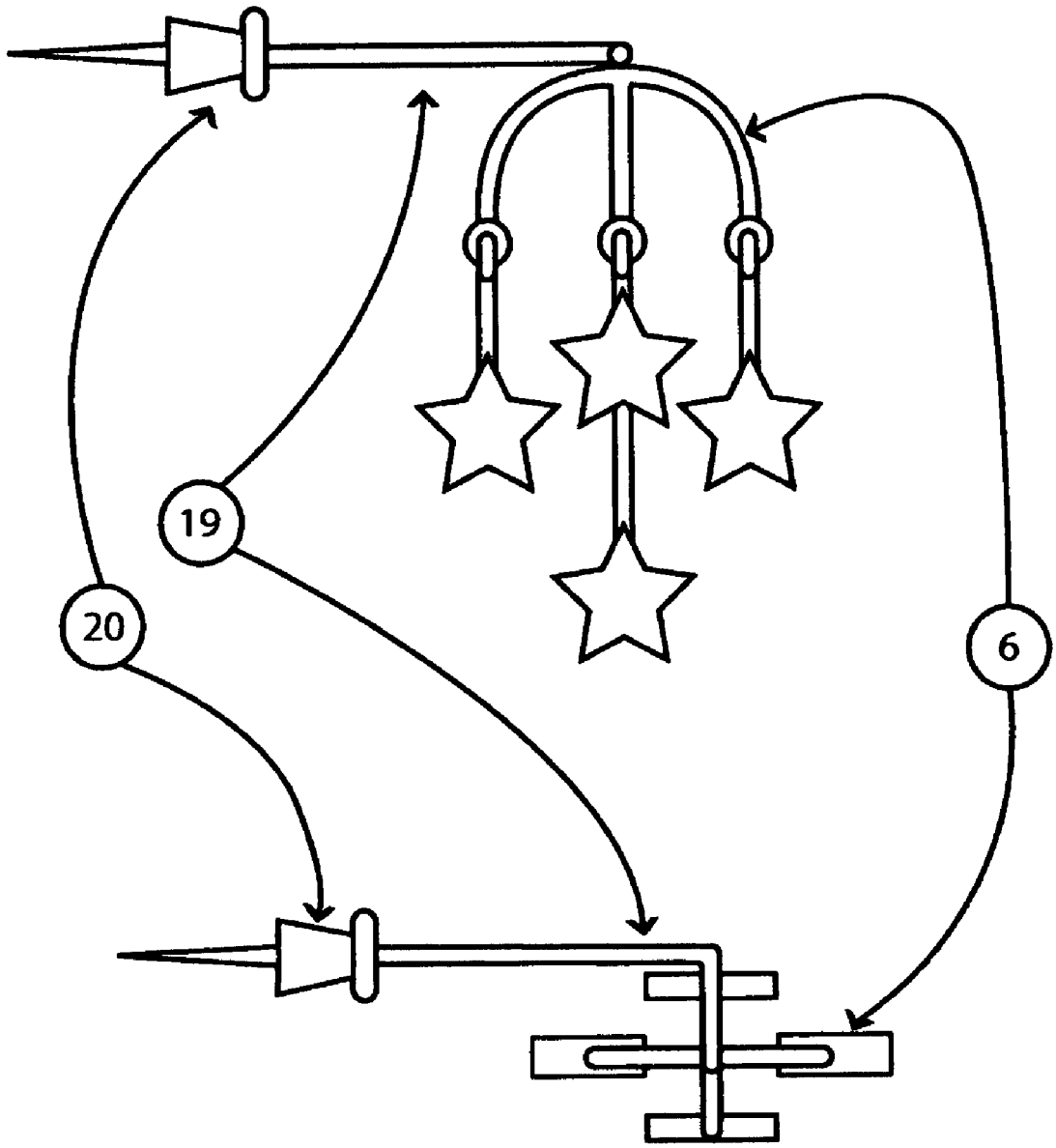
FIG. 14 is a frame assembly as used with a stick pin that includes a horizontal 90 degree bend in the pin to assist in stability of the frame assembly

FIG. 14 shows one configuration of a frame assembly as displayed on a stickpin. The stick pin 19 is secured to the wearer by a clutch back 20. The frame assembly shown is four legged 6 and symmetrical.

Figure 16:
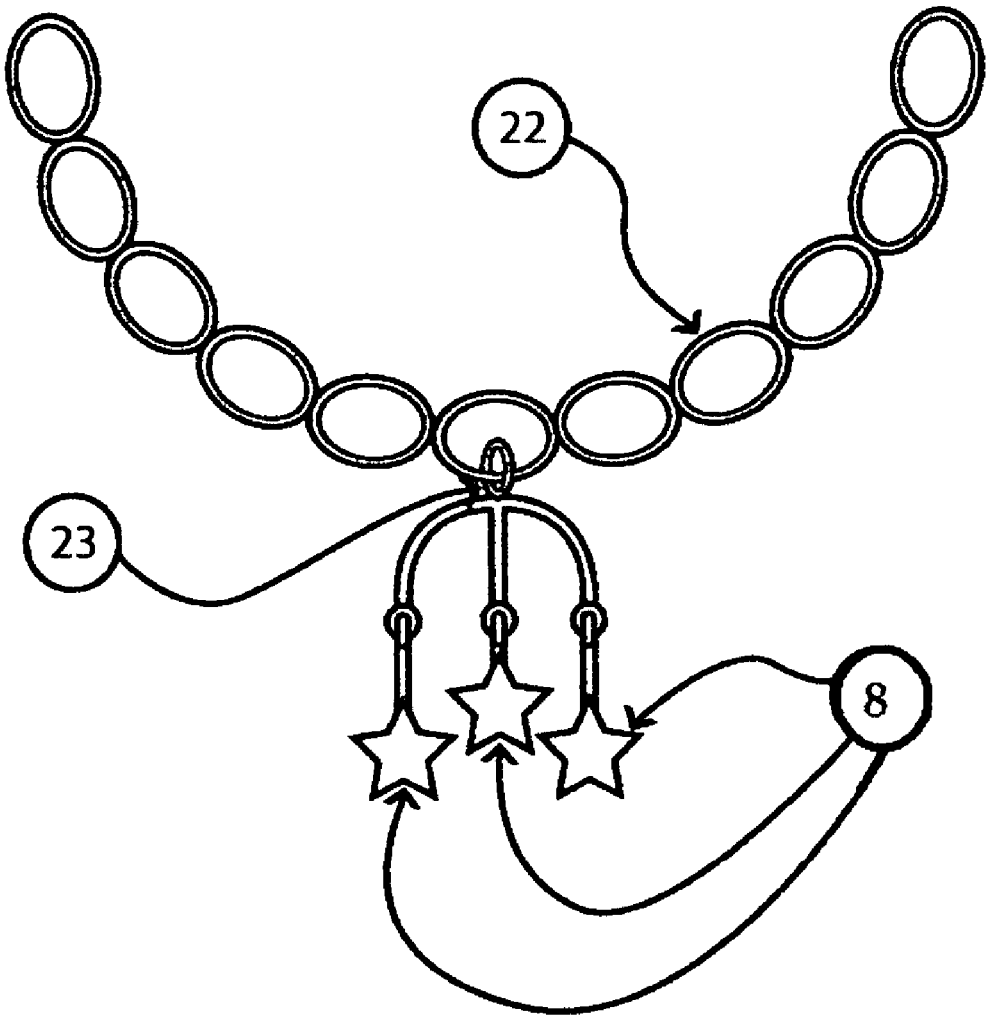
FIG. 16 is a frame assembly attached as the charm for a charm bracelet

FIG. 16 depicts a charm bracelet 22 and a loop attachment 23 to a three legged symmetrical frame assembly. Sample decorative elements 8 are included.

Figure 15:
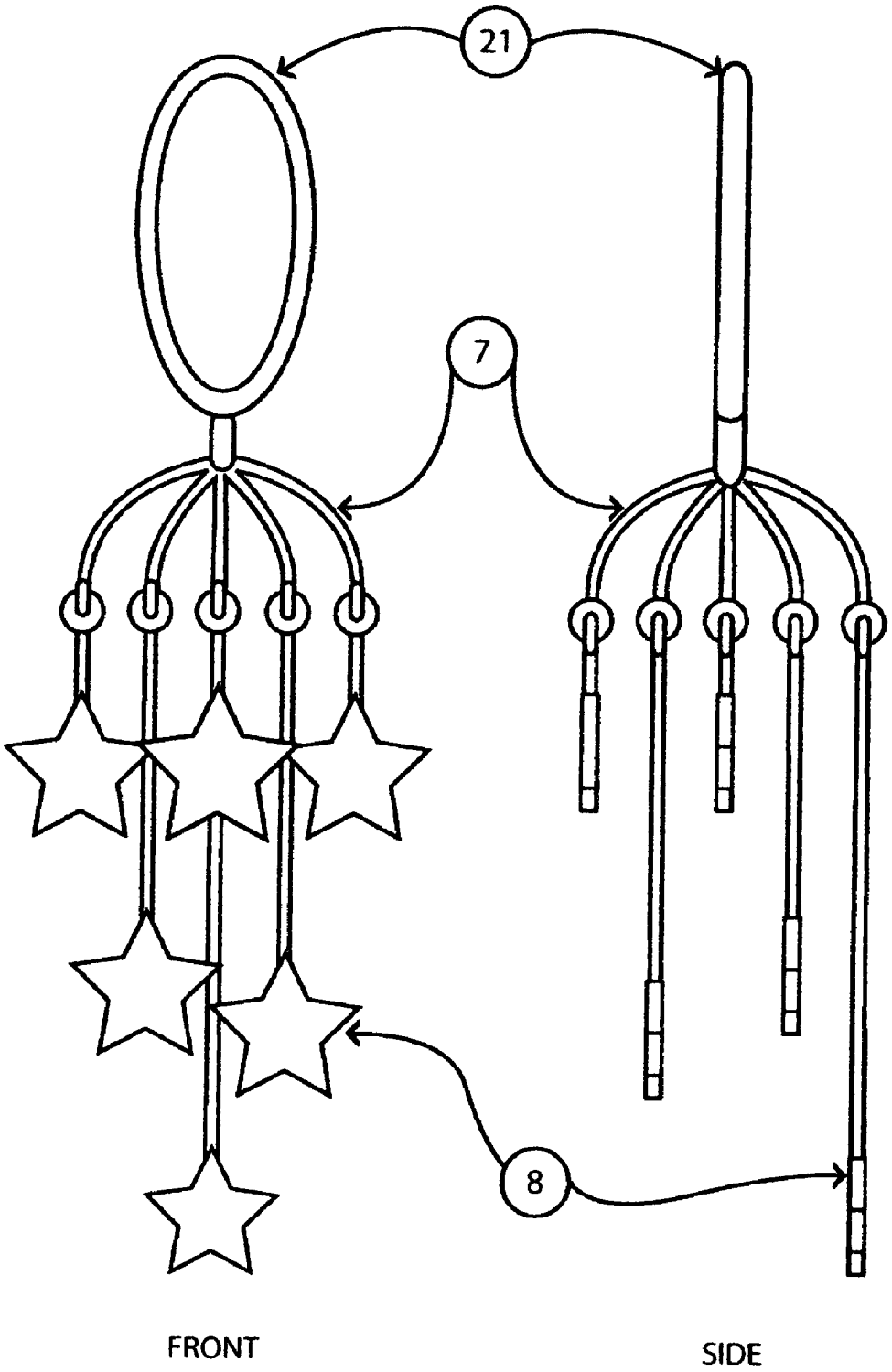
FIG. 15 is a frame assembly as used with an ornament as for a Christmas tree

FIG. 15 shows the use of a six legged symmetrical frame assembly 7 as display feature allowing objects to appear in different planes for an ornament. The connection is accomplished in this depiction as a wire loop 21. Decorative elements are indicated by the numeral 8.

Figure 17:
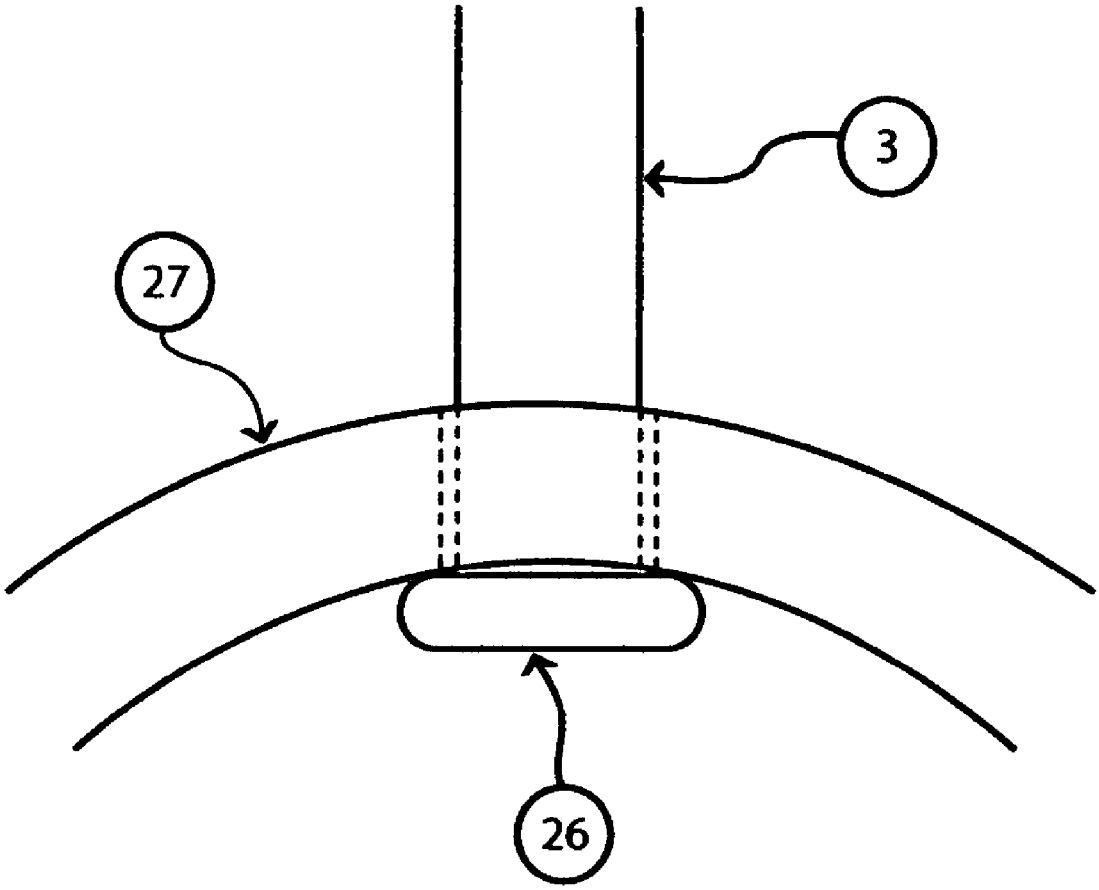
FIG. 17 shows a four legged frame assembly that includes a device to allow rotation of the frame about the vertical member. Additionally detail of the area around the rotation device is shown
Figure 18:
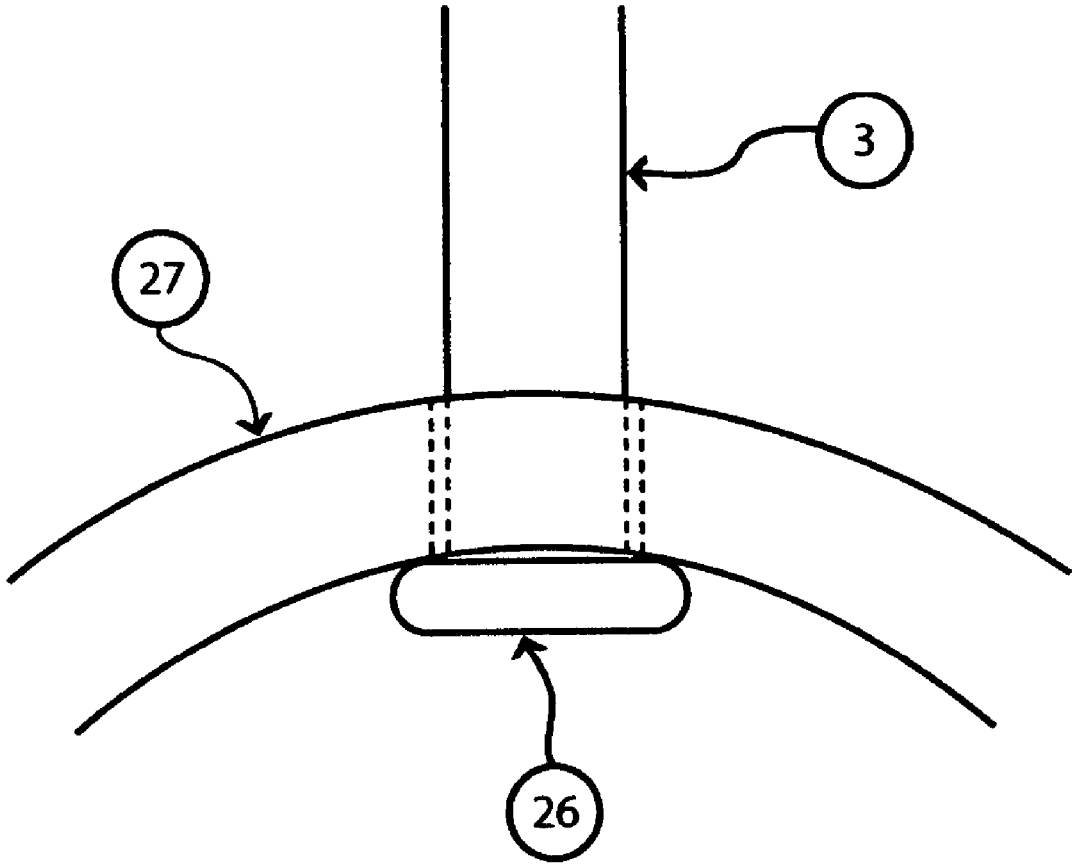
FIG. 18 is the upper portion of a frame assembly showing detail of a rotation device

FIG. 17 and FIG. 18 reveal a frame assembly detail that includes a device 26 to permit or promote rotation of the frame assembly 27 about the vertical member 3.

Figure 19:
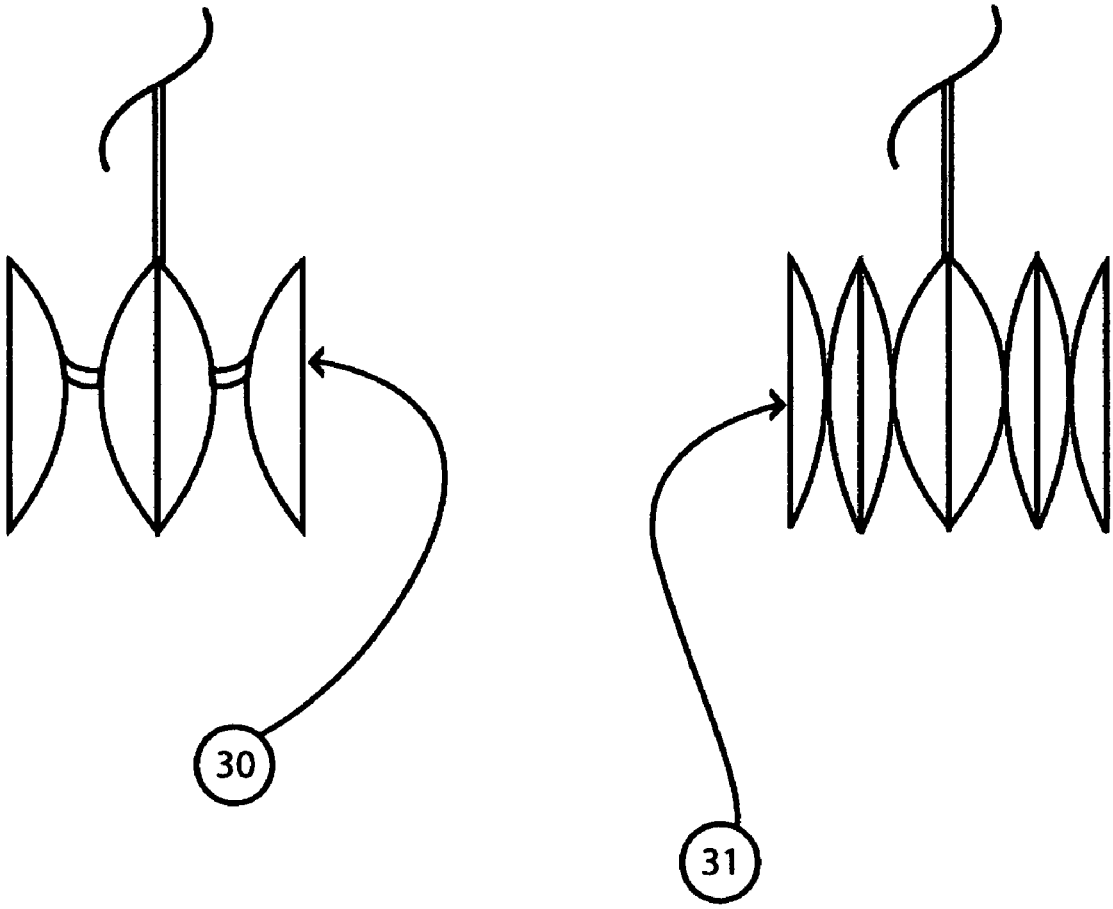
FIG. 19 shows two inverted frame assemblies, one with four legs and decorative elements and the other with eight legs and decorative elements
Figure 20:
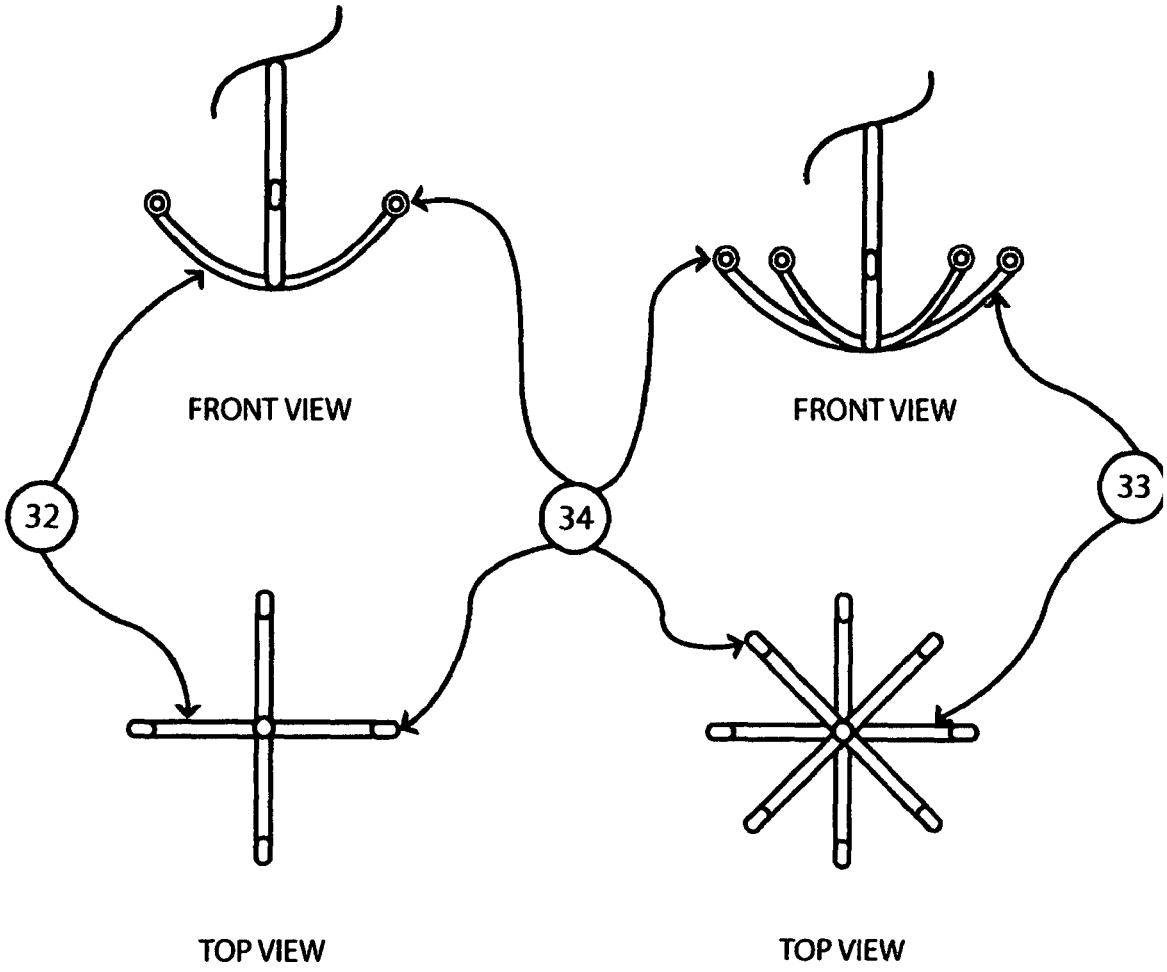
FIG. 20 shows front and side views of four and eight legged inverted frame assemblies and identifies the connecting devices

FIGS. 19-20 show inverted frame applications. In these applications orientation of the decorative elements may be configured to cover the legs of the frame as indicated in the 8 legged inverted symmetrical frame assembly 31 of FIG. 19. A four legged symmetrical version is also shown 30 there. FIG. 20. depicts top and front views of four legged 32 and eight legged 33 inverted symmetrical frame assemblies. The connecting elements 34 are noted.

Figure 21:
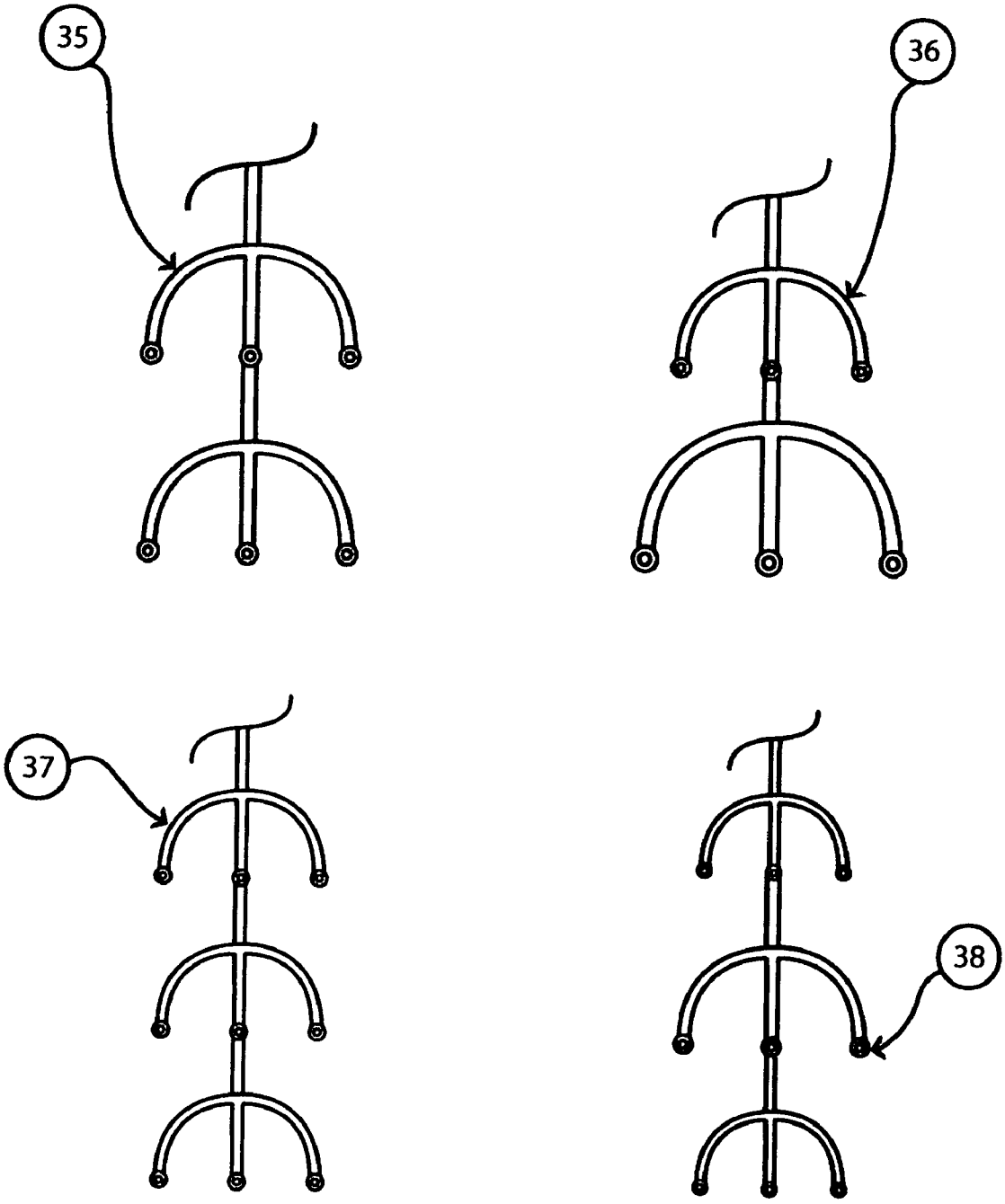
FIG. 21 shows stacked frame assemblies including two similar four legged, two dissimilar four legged, three similar four legged and three dissimilar four legged examples

FIG. 21. shows stacked frame assembly configurations for matching double four legged 35, triple matching four legged 37, dual un-matching four legged 36 and un-matching triple four legged versions.

Although the present invention has been described with reference to particular embodiments, workers skilled in the art will recognize that changes may be made in form and detail without departing from the spirit and scope of this invention.

What is claimed is:

1. A jewelry device comprising:

a stud and wire assembly with one end of a vertical member connected to said stud and wire assembly and an other end of said vertical member connected to a frame assembly, and said frame assembly comprising at least two legs, wherein one end of each of said legs is coupled to the other end of said vertical member and wherein an other end of each of said legs includes a ring with at least two outwardly projecting nubs and hanging therefrom is a decorative element.

2. The jewelry device of claim 1 wherein the stud includes a hollow interior with a slot cutout in the shape of a "T" from a bottom perspective.

3. The jewelry device of claim 2 wherein the stud includes a slot across its bottom aligned perpendicular to the wire.

4. The jewelry device of claim 1 wherein the ring defines a first ring that includes an inner void and wherein the frame assembly further comprises a second ring which penetrates the inner void of the first ring and provides hanging support for the decorative element.

5. The jewelry device of claim 4 wherein the second ring includes at least two nubs outwardly projecting therefrom.

6. A jewelry device comprising:

a frame assembly, and means for vertically hanging said frame assembly, said frame assembly comprising at least two legs each including a decorative element hanging ring including at least two outwardly projecting nubs.

7. The jewelry device of claim 6 wherein each ring defines a first ring that includes an inner void and wherein the frame assembly further comprises second rings each of which penetrates the inner void of a different one of the first rings and provides hanging support for a decorative element.

8. The jewelry device of claim 7 wherein each second ring includes at least two nubs outwardly projecting therefrom.

9. The jewelry device of claim 6 wherein the means for hanging said frame assembly comprises a vertical member.

10. The jewelry device of claim 9 including means between said vertical member and said frame assembly for promoting rotation of the of said frame member on said member.

11. The jewelry device of claim 6 wherein the means for hanging said frame assembly comprises a loop attachment.

12. The jewelry device of claim 6 wherein the means for hanging said frame assembly comprises a stud and wire assembly.

13. The jewelry device of claim 6 wherein the means for hanging said frame assembly comprises a stick pin.

14. The jewelry device of claim 6 wherein the means for hanging said frame assembly comprises a wire loop.

15. The jewelry device of claim 6 wherein the means for hanging said frame assembly comprises a decorative pendant loop.

16. A jewelry device comprising a vertically extending member and at least first and second frame assemblies coupled in different planes to the vertical member and each comprising at least two legs with one end coupled to said vertical member and another end including a ring for supporting a decorative element having at least two outwardly projecting nubs.

17. The jewelry device of claim 16 wherein each ring is a first ring and further comprising a second ring extending from at least one of the first rings and including two outwardly projecting nubs.

* * * * *